US009561647B2

(12) United States Patent
Watanabe et al.

(10) Patent No.: US 9,561,647 B2
(45) Date of Patent: Feb. 7, 2017

(54) PRINT CONTROL APPARATUS AND PRINT CONTROL PROGRAM

(71) Applicant: SEIKO EPSON CORPORATION, Tokyo (JP)

(72) Inventors: Ikumi Watanabe, Nagano (JP); Hiromichi Yamagishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 14/828,914

(22) Filed: Aug. 18, 2015

(65) Prior Publication Data

US 2016/0059545 A1 Mar. 3, 2016

(30) Foreign Application Priority Data

Aug. 29, 2014 (JP) ..... 2014-175128

(51) Int. Cl.
*B41J 29/38* (2006.01)
*B41J 2/045* (2006.01)
*B41J 3/46* (2006.01)

(52) U.S. Cl.
CPC ..... *B41J 2/04586* (2013.01); *B41J 3/46* (2013.01)

(58) Field of Classification Search
None
See application file for complete search history.

(56) References Cited

U.S. PATENT DOCUMENTS 7,248,382 B2 * 7/2007 Haines ..... G06F 3/1205 358/1.11
2008/0258374 A1 * 10/2008 Inoue ..... B65H 3/44 271/9.03
2010/0098450 A1 * 4/2010 Nakazawa ..... G03G 15/553 399/82
2011/0164276 A1 * 7/2011 Hata ..... G06F 3/1258 358/1.15
2012/0075676 A1 * 3/2012 Komoto ..... G06T 11/206 358/1.18

FOREIGN PATENT DOCUMENTS

JP 2010-042893 A 2/2010

OTHER PUBLICATIONS

Honma, Tomoyuki, Device and Method for Acquiring Status of Image Processor, Program for Executing Same Method and Recording Medium With Same Program Recorded, Jun. 8, 2006, Japan, pp. 1-17.*

* cited by examiner

*Primary Examiner* — Matthew Luu
*Assistant Examiner* — Tracey McMillion
(74) *Attorney, Agent, or Firm* — Global IP Counselors, LLP

(57) ABSTRACT

A print control apparatus includes: a display control unit that provides a plurality of choices for a type of printing medium and causes a user interface, on which one of the plurality of choices is selected by a user, to be displayed on a screen; and a storage unit that stores history of the choices selected at least twice. The display control unit first provides one or more choices of the plurality of choices on the user interface based on the history.

15 Claims, 11 Drawing Sheets

FIG. 2

| LATEST | UPPER TRAY | |
|---|---|---|
| | 2L | GLOSSY PAPER |
| | KG | MATTE PAPER |
| PREVIOUS TIME | L | MATTE PAPER |

| | LOWER TRAY | |
|---|---|---|
| PREVIOUS TIME | A4 | RECYCLED PAPER |
| | B5 | REGULAR PAPER |

10
SELECT OPERABLE TRAY FOR PAPER FEEDING
101
UPPER STAGE
103
102
LOWER STAGE
104
OK
105

10
SELECT PAPER SHEET SIZE
106
2L
107
KG
108
L
OK
111

10
SELECT PAPER SHEET SIZE
109
A4
110
B5
OK
111

SELECT PAPER PROPERTY
112
GLOSSY PAPER
REGULAR PAPER
114
113
MATTE PAPER
RECYCLED PAPER
115
OK
116

FIG. 5

| LATEST | UPPER TRAY | |
|---|---|---|
| | 2L | GLOSSY PAPER |
| | KG | MATTE PAPER |
| PREVIOUS TIME | L | MATTE PAPER |

| | LOWER TRAY | |
|---|---|---|
| PREVIOUS TIME | A4 | RECYCLED PAPER |
| | B5 | REGULAR PAPER |
| | 2L | MATTE PAPER |
| | KG | GLOSSY PAPER |
| | L | GLOSSY PAPER |

FIG. 11

LATEST

| | |
|---|---|
| A4 | REGULAR PAPER |
| A4 | REGULAR PAPER |
| 2L | GLOSSY PAPER |
| A4 | REGULAR PAPER |
| L | MATTE PAPER |
| A4 | RECYCLED PAPER |
| B5 | REGULAR PAPER |
| 2L | MATTE PAPER |
| A4 | REGULAR PAPER |
| L | GLOSSY PAPER |

OLDEST

PRINT CONTROL APPARATUS AND PRINT CONTROL PROGRAM

CROSS REFERENCES TO RELATED APPLICATIONS

The entire disclosure of Japanese Patent Application No. 2014-175128, filed Aug. 29, 2014 is incorporated by reference herein.

BACKGROUND

1. Technical Field

The present invention relates to a print control apparatus and a print control program.

2. Related Art

JP-A-2010-42893 discloses a printing apparatus that includes a paper cassette which accommodates two stages of trays. The printing apparatus includes a switching unit that sets one of the two stages of trays as an operable tray and a paper sheet is supplied from the operable tray.

However, in a case where types of paper sheets which are held in a plurality of stages of trays, respectively are set by a user, there is a problem in that operations are complicated.

SUMMARY

An advantage of some aspects of the invention is to realize a print control apparatus in which it is easy to set types of paper sheets which are held in a plurality of stages of trays and a print control program.

According to an aspect of the invention, there is provided a print control apparatus that controls a printing apparatus which performs printing on a printing medium, the print control apparatus including: a display control unit that provides a plurality of choices for a type of printing medium and causes a user interface, on which one of the plurality of choices is selected by a user, to be displayed on a screen; and a storage unit that stores history of the choices selected at least twice. The display control unit first provides one or more choices of the plurality of choices on the user interface based on the history.

In this case, since the history of the types of paper sheets selected at least twice is stored and the types of paper sheets are selected based on the history, it is easy to set the types of paper sheets. The providing of the plurality of choices does not limited to the providing of the plurality of choices at once but includes a case in which the choices to be provided are switched in order.

A function of each unit described in the aspects of the invention is realized by a hardware resource having a function specified by its configuration, a hardware resource having a function specified by a program, and a combination thereof. In addition, the functions of the respective units are not limited to functions realized by the hardware resources which are physically separated from each other.

BRIEF DESCRIPTION OF THE DRAWINGS

The invention will be described with reference to the accompanying drawings, wherein like numbers reference like elements.

FIG. 2 is a diagram of a data configuration according to the embodiment of the invention.

FIG. 5 is a diagram of a data configuration according to another embodiment of the invention.

FIG. 11 is a diagram of a data configuration according to the embodiment of the invention.

DESCRIPTION OF EXEMPLARY EMBODIMENTS

Figure 1:
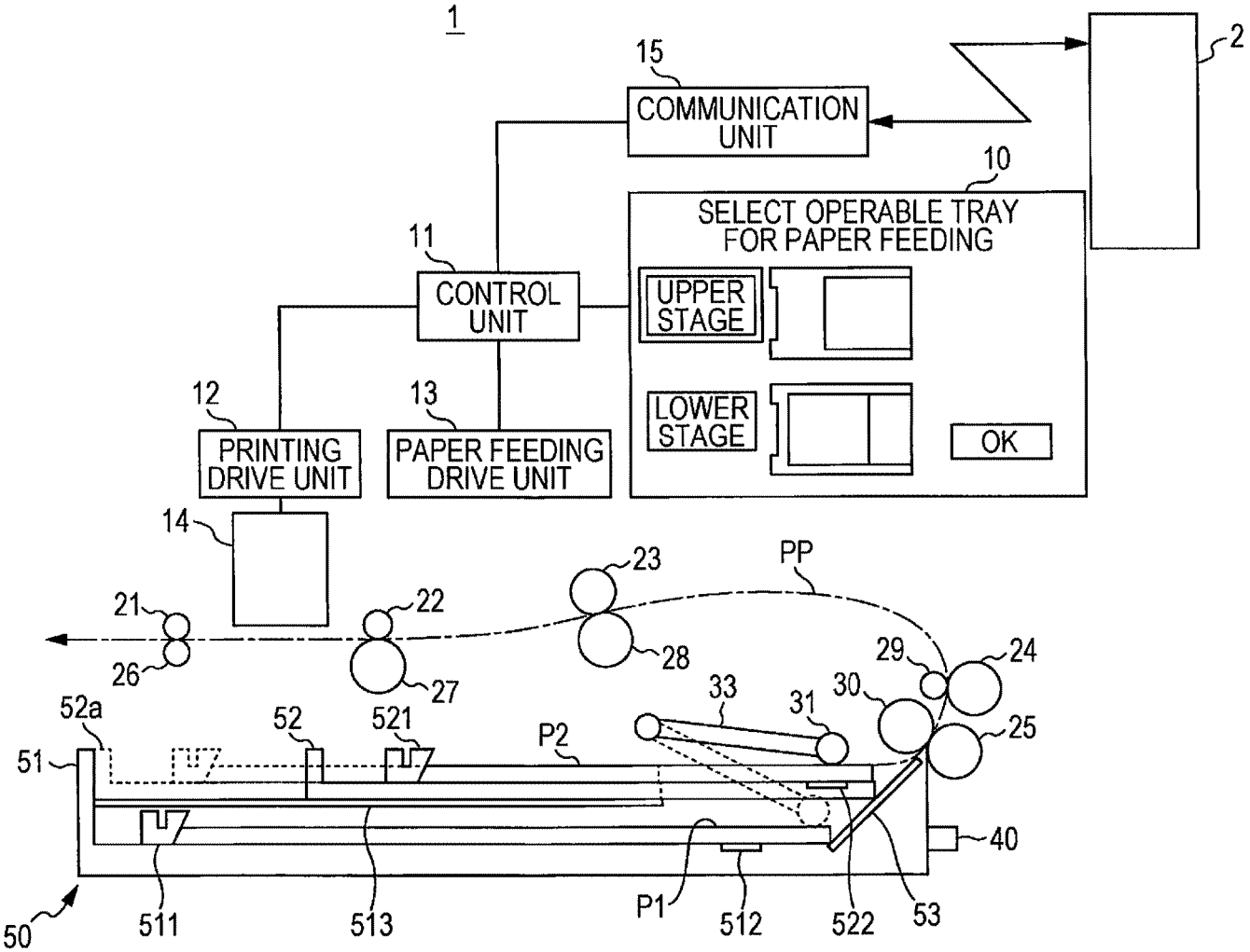
FIG. 1 is a schematic diagram according to an embodiment of the invention.

Hereinafter, embodiments of the invention will be described with reference to the drawings. The same reference signs are attached to components corresponding to each other in the drawings and repetitive descriptions are omitted.

1. COMMON CONFIGURATION

A printer 1 shown in FIG. 1 as an example of the invention is an ink jet printer that performs printing on a paper sheet which is picked out as a printing medium from a paper cassette 50 which includes a lower tray 51 and an upper tray 52. One tray from which the paper sheet is picked out during a printing operation is referred to as an operable tray of two trays included in the paper cassette 50.

The paper cassette 50 is configured to be attachable to and detachable from the printing unit to be described below. The printer 1 includes a sensor 40 that detects attachment and detachment of the paper cassette 50. The paper cassette 50 includes the lower tray 51 that holds a paper-sheet bundle P1 and the upper tray 52 that holds a paper-sheet bundle P2. The lower tray 51 constitutes an outer frame of the paper cassette 50. A guide 513 is provided inside the lower tray 51 to hold the upper tray 52 inside the lower tray 51 in a slidable manner. The guide 513 guides the upper tray 52 in a direction in which a paper sheet moves forward in the lower tray 51. Here, the direction in which the paper sheet moves forward in the lower tray 51 during paper feeding is referred to as a forward direction and a direction opposite to the forward direction is referred to as a retracted direction. The farthest position which the upper tray 52 reaches in the forward direction with respect to the lower tray 51 as shown by a solid line is referred to as a forward position and the farthest position which the upper tray 52 reaches in the retracted direction with respect to the lower tray 51 as shown by a dotted line is referred to as a retracted position. The upper tray 52 is locked to the lower tray 51 at each of the forward position and the retracted position.

A sliding guide 511 for holding a paper sheet having a predetermined size at a predetermined position is provided in the lower tray 51. A sliding guide 521 for holding a paper sheet having a predetermined size at a predetermined position is provided in the upper tray 52. The printer 1 is not equipped with a sensor that detects positions of the sliding guides 511 and 521 or properties of a paper sheet. Thus, in the printer 1, sizes and properties of the paper sheets which are held in the lower tray 51 and the upper tray 52 are set by the user, respectively.

The printing unit includes a pick-up roller 31, paper transport rollers 30, 24, 23, 27, and 26, a separation roller 25, driven roller 29, 28, 22, and 21, a print head 14, a printing drive unit 12, a paper feeding drive unit 13, or the like. The print head 14 includes an actuator that discharges an ink and a drive circuit thereof. The printing drive unit 12 includes an actuator which causes the print head 14 to move in a main scanning direction perpendicular to the paper transport direction and a drive circuit thereof. The paper feeding drive unit 13 includes an actuator that causes the pick-up roller 31 and the paper transport rollers 30, 24, 23, 27, and 26 to rotate and a drive circuit thereof.

The pick-up roller 31 has a rotating shaft that is supported on one end of a pivot shaft 33. The other end of the pivot shaft 33 is rotatably supported on a bearing (not shown). A spring (not shown) which pushes out the pivot shaft 33 such that the pick-up roller 31 is pressed against the paper-sheet bundle P1 or paper-sheet bundle P2.

When the upper tray 52 is set at the forward position, the pick-up roller 31 comes into contact with the paper-sheet bundle P2 which is held in the upper tray 52 and picks out the uppermost paper sheet of the paper-sheet bundle P2 through rotation of the roller. The picked paper sheet is transported through a paper feeding path PP by the paper transport rollers 30, 24, 23, 27, and 26, the separation roller 25, the driven roller 29, 28, 22, and 21. The print head 14 performs printing on the paper sheet that is transported through the paper feeding path PP. That is, when the upper tray 52 is set at the forward position, the upper tray 52 is set as an operable tray. When the upper tray 52 is set at the retracted position, the pick-up roller 31 comes into contact with the paper-sheet bundle P1 which is held in the lower tray 51 and picks out the uppermost paper sheet of the paper-sheet bundle P1 through rotation of the roller. That is, when the upper tray 52 is set at the retracted position, the lower tray 51 is set as an operable tray. In this manner, the guide 513 of the lower tray 51 and the upper tray 52 configure a switching unit which sets one of the lower tray 51 and the upper tray 52 as the operable tray.

The printer 1 does not include a sensor that performs detection of which one of the lower tray 51 and the upper tray 52 is the operable tray. Thus, in the printer 1, the operable tray is set by a user.

The printer 1 includes a control unit 11 which causes a user interface, on which the operable tray and the sizes and properties of the paper sheet are set by the user, to be displayed on a screen of a touch panel 10 or a screen of an external portable information terminal 2. In addition, the printer 1 includes a communication unit 15 for communicating with the external portable information terminal 2 using WiFi, near field communication (NFC), or the like. The control unit 11 is a computer that controls the printing drive unit 12, the paper feeding drive unit 13, the communication unit 15, and the user interface. The control unit 11 includes a processor, a main memory, an input/output mechanism, and an external nonvolatile memory, executes a print control program which is stored in the external memory, and thereby, controls the printing drive unit 12, the paper feeding drive unit 13, the communication unit 15, and the user interface.

2. EXAMPLE 1

According to the present example, the size of the paper sheet that can be held in the lower tray 51 and the size of the paper sheet that can be held in the upper tray 52 are not the same but are different from each other. The size of the paper sheet that can be held in the lower tray 51 and the choices of the sizes of paper sheets which can be set for the lower tray 51 are "A4" and "B5". The size of the paper sheet that can be held in the upper tray 52 and the choices of the sizes of paper sheets which can be set for the upper tray 52 are "2L", "king size", and "L".

As shown in FIG. 2, the control unit 11 according to the present example stores, for each tray, the size and property of a paper sheet which is held in a tray in response to setting by a user. Specifically, for each size of paper sheets, one tray and the latest set property (glossy paper, matte paper, recycled paper, and regular paper) of the paper sheet for the corresponding size are associated with each other and stored in the external nonvolatile memory. In addition, for the latest set size of the paper sheet, a flag (in FIG. 2, characters of "previous time" represents a flag) for identifying the latest set size of the paper sheet is stored for each tray. Further, for the tray set as the operable tray at the previous time, a flag (in FIG. 2, characters of "latest" represents a flag) for identifying the tray set as the operable tray at the previous time is stored for each tray. In this manner, the control unit 11 stores, as history, the types of paper sheets set by a user for previous five times as a whole, including the other types in addition to the latest set type and the type set one time for each size of the paper sheet. Hereinafter, the history of the operable tray setting and the sizes and properties of the paper sheet is referred to as paper cassette setting.

Figure 3:
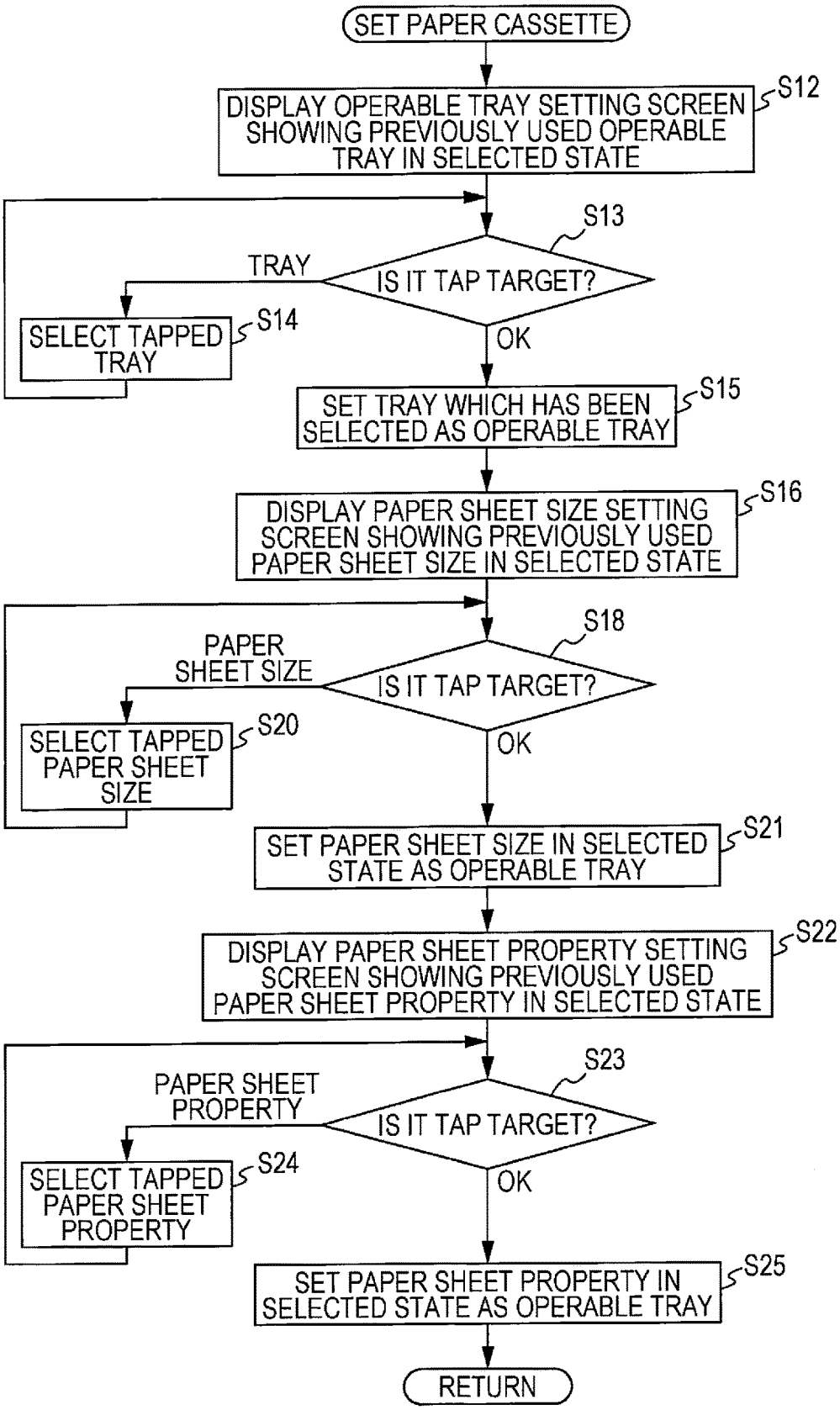
FIG. 3 is a flowchart according to the embodiment of the invention.

Next, the user interface on which the operable tray and the size and property of the paper sheet are set by a user will be described. When the sensor 40 detects attachment of the paper cassette 50, the control unit 11 starts a paper cassette setting process shown in FIG. 3. In the paper cassette setting process of the present example, the control unit 11 causes the user interface shown in FIGS. 4A to 4D to be displayed on the screen of a touch panel 10.

Figures 4A, 4B, 4C, 4D:
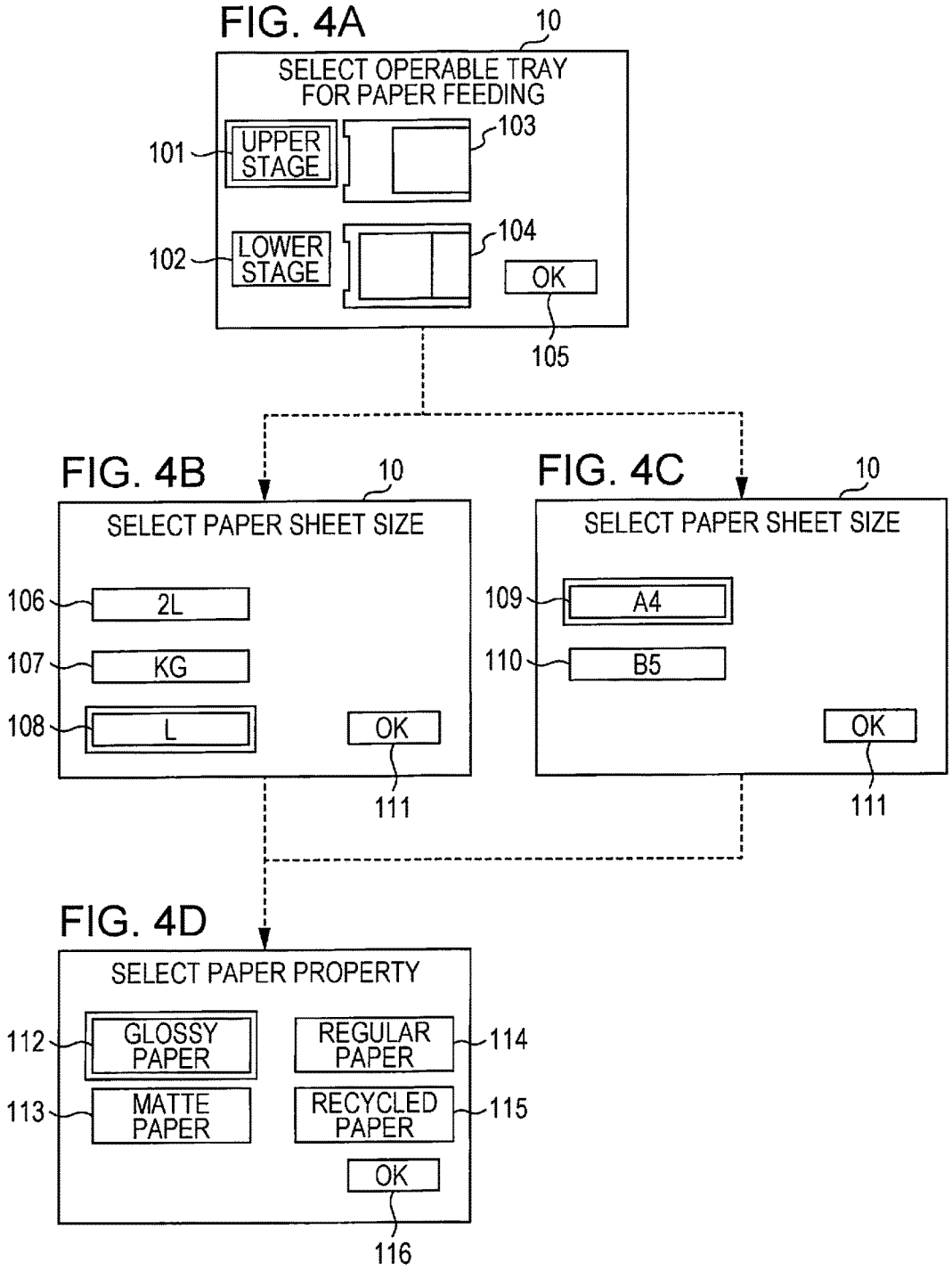
FIGS. 4A to 4D are diagrams of screen transition according to the embodiment of the invention.

First, the control unit 11 displays an operable tray setting screen showing a selection state of the latest set tray as the operable tray, on the touch panel 10 (S12). The operable tray setting screen is an interface on which the setting of which one of the lower tray 51 and the upper tray 52 is set as the operable tray is performed by a user. As shown in FIG. 4A, an icon 101 for selecting the upper tray 52, an icon 102 for selecting the lower tray 51, and an "OK" icon 105 for setting the tray, which is in a selected state, as the operable tray are arranged on the operable tray setting screen. One of the icons 101 and 102 corresponding to the tray, which is in the selected state, is highlighted such that the user can determine the selection state.

In addition, a graphic 103 for identifying a state in which the upper tray 52 is set as the operable tray is disposed in the vicinity of the icon 101 for selecting the upper tray 52. The graphic 103 schematically shows the external appearance of the paper cassette 50 in which the upper tray 52 is set at the forward position. That is, the graphic 103 schematically shows the external appearance of the paper cassette 50 in which the upper tray 52 is set as the operable tray. In addition, a graphic 104 for identifying a state in which the lower tray 51 is set as the operable tray is disposed in the vicinity of the icon 102 for selecting the lower tray 51. The graphic 104 schematically showing the external appearance of the paper cassette 50 in which the upper tray 52 is set at the thickness portion. That is, the graphic 104 schematically shows the external appearance of the paper cassette 50 in which the lower tray 51 is set as the operable tray.

According to the present example, one of the lower tray 51 and the upper tray 52 to be described below is set as the operable tray by a user and the type (size and property) of the paper sheet is set for the operable tray by the user. Thus, transport of the paper sheet is controlled corresponding to the size of the paper sheet set for the operable tray by the user and a discharge amount of an ink is controlled corresponding to the property of the paper sheet set for the operable tray by the user. Further, regardless of the setting by the user, the operable tray, that is, the tray from which the paper sheet as a printing target is picked out, is determined depending on whether the upper tray 52 is set at the forward position or is set at the retracted position. Therefore, when the other tray which is not the operable tray determined corresponding to the position of the upper tray 52 is set as the operable tray by the user, transport is performed corresponding to a paper sheet having a size different from a size of a paper sheet which is actually transported and the discharge amount of the ink is controlled corresponding to a paper sheet having a property different from a property of the paper sheet which is actually transported. The graphics 103 and 104 representing which tray is set as the operable tray by showing the external appearance of the paper cassette 50 are displayed on the operable tray setting screen and thus, it is possible to prevent a setting error of the operable tray and an error with which the paper cassette 50 is set in a wrong manner. The graphics 103 and 104 may represent trays corresponding to the trays, which are in a selected state, respectively. For example, the graphic 103 may be displayed without displaying the graphic 104 in a case where the upper tray 52 is in the selected state and the graphic 104 may be displayed without displaying the graphic 103 in a case where the lower tray 51 is in the selected state.

When a tap is detected by the touch panel 10 on which the operable tray setting screen is displayed, the control unit 11 determines whether tap targets are the icons 101 and 102 for selecting the trays or an "OK" icon 105 for setting a tray, which is in the selected state, as the operable tray (S13).

In a case where the tap targets are the icons 101 and 102 for selecting trays, the control unit 11 selects a tray as the operable tray corresponding to the tapped icon (S14) and repeats the determination in step S13.

In a case where the tap target is the "OK" icon 105 for setting the tray, which is in the selected state, as the operable tray, the control unit 11 sets the tray, which is in the selected state, as the operable tray (S15).

Subsequently, the control unit 11 causes a paper-sheet size setting screen showing a selection state of a previously set paper-sheet size for the set operable tray to be displayed on the touch panel 10 (816). An icon for selecting the paper-sheet size and an icon for the selected paper-sheet size are disposed on the paper-sheet size setting screen. As the icon for selecting the paper-sheet size, icons of respective paper-sheet sizes which can be set for the operable tray are disposed. In addition, the control unit 11 causes the icon for selecting the paper-sheet size, which is in the selected state, to be highlighted.

FIG. 4B shows a paper-sheet size setting screen which is caused to be displayed by the control unit 11 in a case where the upper tray 52 is set as the operable tray in a state in which the setting history by the user as shown in FIG. 2 is stored in the control unit 11. Icons 106, 107, and 108 for selecting paper-sheet sizes and an "OK" icon 111 for setting the paper-sheet size, which is in the selected state, are disposed on the paper-sheet size setting screen. In a case where the setting history by the user as shown in FIG. 2 is stored in the control unit 11, the control unit 11 causes the paper-sheet size setting screen to be displayed in a state in which "L" is selected because the paper-sheet size previously set for the upper tray 52 is "L". FIG. 4C shows a paper-sheet size setting screen which is caused to be displayed by the control unit 11 in a case where the lower tray 51 is set as the operable tray in a state in which the setting history by the user as shown in FIG. 2 is stored in the control unit 11. In a case where the setting history by the user as shown in FIG. 2 is stored in the control unit 11, the control unit 11 causes the paper-sheet size setting screen to be displayed in a state in which "A4" is selected because the paper-sheet size previously set for the lower tray 51 is "A4".

When a tap is detected by the touch panel 10 on which the paper-sheet size setting screen is displayed, the control unit 11 determines whether tap targets are the icons 106 to 110 for selecting paper-sheet sizes or the "OK" icon 111 for setting a paper-sheet size, which is in the selected state (S18).

In a case where the tap targets are the icons 106 to 110 for selecting paper-sheet sizes, the control unit 11 selects a paper-sheet size corresponding to the tapped icon (S20) and repeats the determination in step S18.

In a case where the tap target is the "OK" icon 111 for setting the paper-sheet size, which is in the selected state, the control unit 11 sets the paper-sheet size, which is in the selected state (S21).

Subsequently, the control unit 11 causes a paper-sheet property setting screen showing a selection state of a previously set paper-sheet property in combination with the set paper-sheet size to be displayed on the touch panel 10 (S23). An icon for selecting the paper-sheet property and an icon for the selected paper-sheet property are disposed on the paper-sheet size setting screen. In addition, the control unit 11 causes the icon for selecting the paper-sheet property, which is in the selected state, to be highlighted.

FIG. 4D shows a paper-sheet property setting screen which is caused to be displayed by the control unit 11 in a case where the "L" is set as the paper-sheet size in a state in which the setting history by the user as shown in FIG. 2 is stored in the control unit 11. Icons 112 to 115 for selecting paper-sheet properties and an "OK" icon 116 for setting the paper-sheet size, which is in the selected state, are disposed on the paper-sheet property setting screen. In a case where the setting history by the user as shown in FIG. 2 is stored in the control unit 11, the control unit 11 causes a paper-sheet type setting screen to be displayed in a state in which "glossy paper" is selected because the type of the previously set paper sheet is the "glossy paper" in combination with "L". In a case where "A4" is set as the paper-sheet size, the control unit 11 causes the paper-sheet type setting screen to be displayed in a state in which "recycled paper" is selected because the previously set paper-sheet type is the "recycled paper" in combination with "A4".

When a tap is detected by the touch panel 10 on which the paper-sheet property setting screen is displayed, the control unit 11 determines whether tap targets are the icons 112 to 115 for selecting paper-sheet properties or an "OK" icon 116 for setting a paper-sheet property, which is in the selected state (S23).

In a case where the tap targets are the icons 112 to 115 for selecting trays, the control unit 11 selects a paper-sheet property corresponding to the tapped icon (S24) and repeats the determination in step S23.

In a case where the tap target is the "OK" icon 116 for setting the paper-sheet property, which is in the selected state, the control unit 11 sets the paper-sheet property, which is in the selected state (S25), and the paper cassette setting process ends.

According to Example 1 described above, when the paper cassette 50 is set in the printing unit, the user interface is displayed on the screen of the touch panel 10 and the operable tray is set by the user. Thus, one of the lower tray 51 and the upper tray 52 can be specified as the operable tray without an additional sensor. Since the operable tray setting screen is displayed in a state in which the tray previously set as the operable tray is selected as the operable tray, the number of operations by the user which are needed for setting the operable tray is likely to be decreased. In addition, since the paper-sheet size setting screen is displayed in a state in which the paper-sheet size set for the previous operable tray is selected, the number of operations by the user which are needed for setting the paper-sheet size is stochastically decreased. Further, since the paper-sheet property setting screen is displayed in a state in which the previously set paper-sheet property in combination with the set paper-sheet size are selected, the number of operations by the user which are needed for setting the paper-sheet property is stochastically decreased.

3. EXAMPLE 2

According to the present example, the size of the paper sheet that can be held in the lower tray 51 and the size of the paper sheet that can be held in the upper tray 52 are the same in part and are different from each other in part. The size of the paper sheet that can be held in the lower tray 51 and choices of sizes of paper sheets which can be set for the lower tray 51 are "A4", "B5", "2L", "king size", and "L". The size of the paper sheet that can be held in the upper tray 52 and choices of sizes of paper sheets which can be set for the upper tray 52 are "2L", "king size", and "L". Similar to Example 1, as shown in FIG. 5, according to the present example, the size and property of the paper sheet held in a tray are also stored in the control unit 11 for each tray in accordance with setting of a user.

Figure 6:
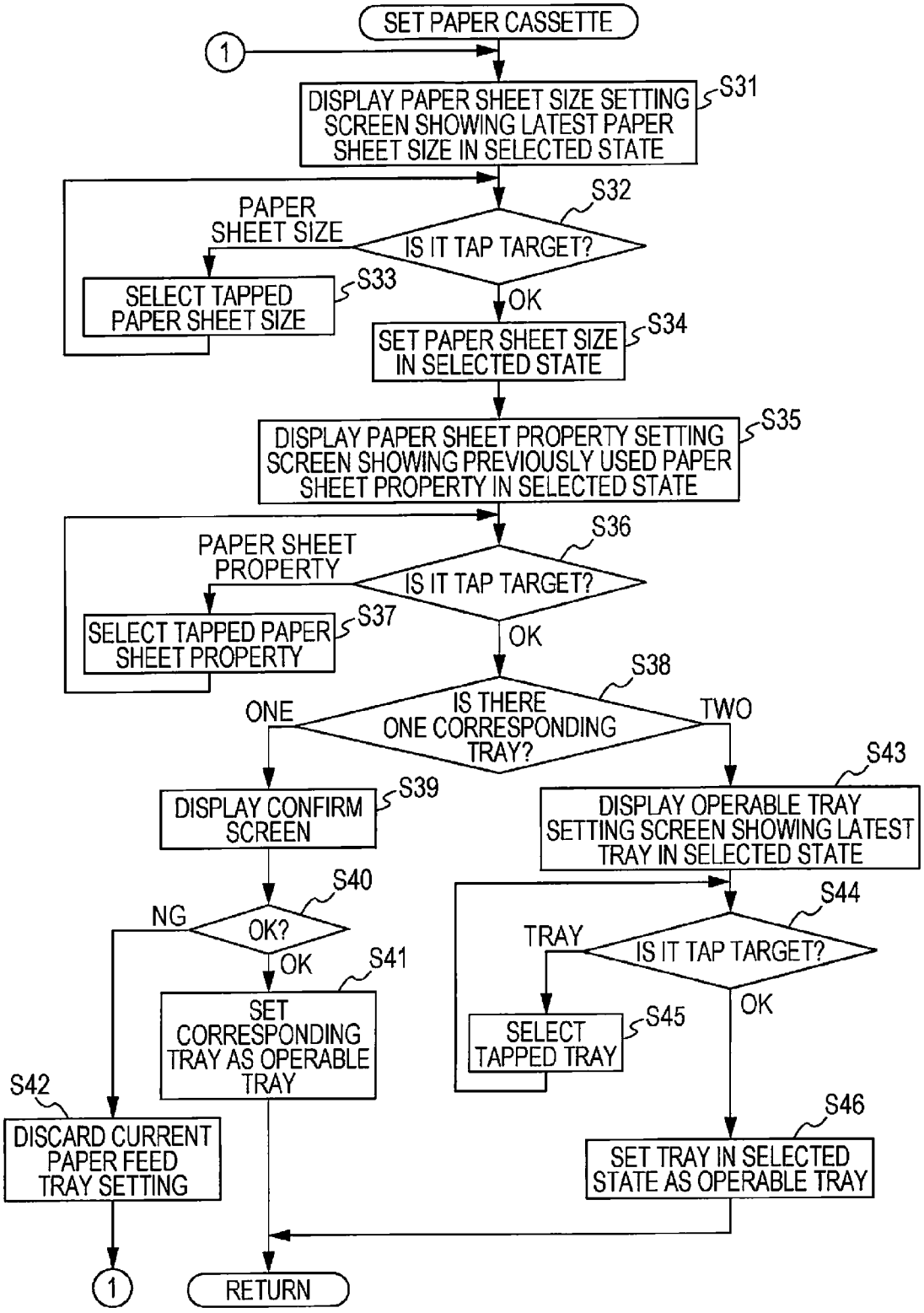
FIG. 6 is a flowchart according to the embodiment of the invention.

Next, the user interface on which the operable tray and a size and property of the paper sheet are set by a user will be described. When the sensor 40 detects attachment of the paper cassette 50, the control unit 11 starts the paper cassette setting process shown in FIG. 6. In the paper cassette setting process of the present example, the control unit 11 causes the user interface shown in FIGS. 7A to 7D to be displayed on the screen of a touch panel 10.

Subsequently, the control unit 11 causes a paper-sheet size setting screen showing a selection state of the latest set paper-sheet size to be displayed on the touch panel 10 (S31). An icon for selecting the paper-sheet size which can be set for at least one of the lower tray 51 and the upper tray 52 and an icon for setting the selected paper-sheet size are disposed on the paper-sheet size setting screen.

Figure 7A:
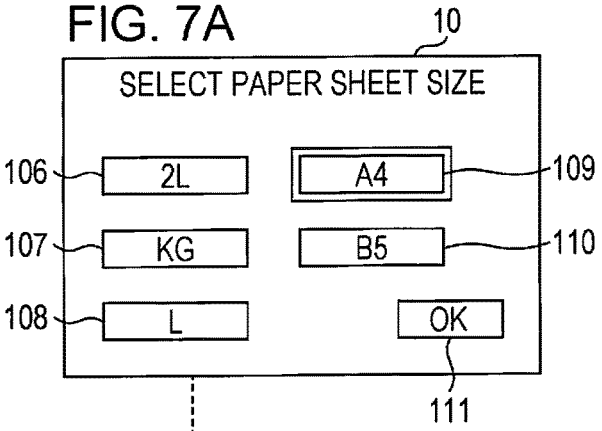
FIGS. 7A to 7D are diagrams of screen transition according to the embodiment of the invention.

FIG. 7A shows a paper-sheet size setting screen which is caused to be displayed by the control unit 11 in a state in which the setting history by the user as shown in FIG. 5 is stored in the control unit 11. Icons 106 to 110 for selecting paper-sheet sizes and an "OK" icon 111 for setting the paper-sheet size, which is in the selected state, are disposed on the paper-sheet size setting screen. In a case where the setting history by the user as shown in FIG. 5 is stored in the control unit 11, the lower tray 51 is set as the previously set operable tray and the previous "A4" is set as the paper-sheet size for the lower tray 51. Thus, the control unit 11 causes the paper-sheet size setting screen in a state in which the "A4" is selected to be displayed.

When a tap is detected by the touch panel 10 on which the paper-sheet size setting screen is displayed, the control unit 11 determines whether tap targets are the icons 106 to 110 for selecting paper-sheet sizes or the "OK" icon 111 for setting a paper-sheet size, which is in the selected state (S32).

In a case where the tap targets are the icons 106 to 110 for selecting paper-sheet sizes, the control unit 11 selects a paper-sheet size corresponding to the tapped icon (S33) and repeats the determination in step S31.

In a case where the tap target is the "OK" icon 111 for setting the paper-sheet size, which is in the selected state, the control unit 11 sets the paper-sheet size, which is in the selected state (S34).

Subsequently, similar to Example 1, the control unit 11 causes the paper-sheet property setting screen showing a selection state of a previously set paper-sheet property in combination with the set paper-sheet size to be displayed on the touch panel 10 (S35).

When a tap is detected by the touch panel 10 on which the paper-sheet property setting screen is displayed, the control unit 11 determines whether tap targets are the icons 112 to 115 for selecting paper-sheet properties or the "OK" icon 116 for setting a paper-sheet property, which is in the selected state (S36).

In a case where the tap targets are the icons 112 to 115 for selecting trays, the control unit 11 selects a paper-sheet property corresponding to the tapped icon (S37) and repeats the determination in step S36.

In a case where the tap target is the "OK" icon 116 for setting the paper-sheet property, which is in the selected state, the control unit 11 determines whether the number of trays which can hold the set size of the paper sheet is one or two (S38). Specifically, among "A4", "B5", "2L", "king size", and "L", "2L", "king size", and "L" can be held in both the lower tray 51 and the upper tray 52 and "A4" and "B5" can be held only in the lower tray 51. Thus, in a case where the set paper-sheet size is "A4" or "B5", the control unit 11 determines that one tray can hold the set paper-sheet size.

When it is determined that one tray can hold the set paper-sheet size, the control unit 11 causes a confirmation screen, on which the corresponding one tray is set as the operable tray is confirmed by the user, to be displayed on the touch panel 10 (S40). A graphic for identifying a state of the paper cassette 50 in which a tray which can hold the set paper-sheet size is set as the operable tray is disposed on the confirmation screen. Specifically, the graphic 104 that schematically depicts the external appearance of the paper cassette 50 in which the lower tray 51 is set as the operable tray is displayed on the confirmation screen.

The "OK" icon 116 and an "NG" icon 117 are disposed on the confirmation screen and are displayed on the confirmation screen until the "OK" icon 116 or the "NG" icon 117 is tapped. Without disposing the "OK" icon 116 and an "NG" icon 117, the process may proceed to the next process after a certain time elapses. In addition, the graphic for identifying the state of the paper cassette 50 in which the tray which can hold the set paper-sheet size may be displayed in association with the paper-sheet size, which is in the selected state, on the paper-sheet size setting screen. Specifically, the graphic 104 may be displayed in a case where the paper-sheet size which can be held only in the lower tray 51 is selected but the graphic 104 may not be displayed in a case where a paper-sheet size which can be held in both the lower tray 51 and the upper tray 52 is selected.

When a tap is detected by the touch panel 10 on which the confirmation screen is displayed, the control unit 11 determines whether a tap target is one of the "OK" icon 116 and the "NG" icon 117 (S40).

In the case where the tap target is the "NG" icon 117, the control unit 11 discards the setting of the currently set size and type of the paper sheet (S42) and the paper cassette setting process is again performed from the start.

In the case where the tap target is the "OK" icon 116, the control unit 11 sets the lower tray 51 which is the only tray, in which the set paper-sheet size can be held, as the operable tray (S41) and the paper cassette setting process ends.

Meanwhile, in step S38, when it is determined that two trays can hold the paper sheet having the set size, similar to Example 1, the control unit 11 causes the operable tray setting screen showing a selection state of the tray set as the latest operable tray to be displayed on the touch panel 10 (S43).

Subsequently, when a tap is detected by the touch panel 10 on which the operable tray setting screen is displayed, the control unit 11 determines whether a tap target is the icons 101 and 102 for selecting trays or the "OK" icon 105 for setting a tray, which is in the selected state, as the operable tray (S44).

In a case where the tap target is the icons 101 and 102 for selecting trays, the control unit 11 selects a tray as the operable tray corresponding to the tapped icon (S45) and repeats the determination in step S44.

In a case where the tap target is the "OK" icon 105 for setting the tray, which is in the selected state, as the operable tray, the control unit 11 sets the tray, which is in the selected state, as the operable tray (S46) and the paper cassette setting process ends.

According to Example 2 described above, before setting of which one of the lower tray 51 and the upper tray 52 is set as the operable tray is performed by the user, the size of a printing paper sheet is set by the user. Then, when the size of the printing paper sheet which can be held only in the lower tray 51 is set, the lower tray 51 is viewed as the operable tray and setting is performed and thus, the number of operations needed by the user can be decreased. In addition, even when the lower tray 51 is viewed and set as the operable tray, whether the lower tray 51 is the operable tray is confirmed by the user and thus, it is possible to prevent an error with which the paper cassette is set in a wrong manner.

4. EXAMPLE 3

Figure 8:
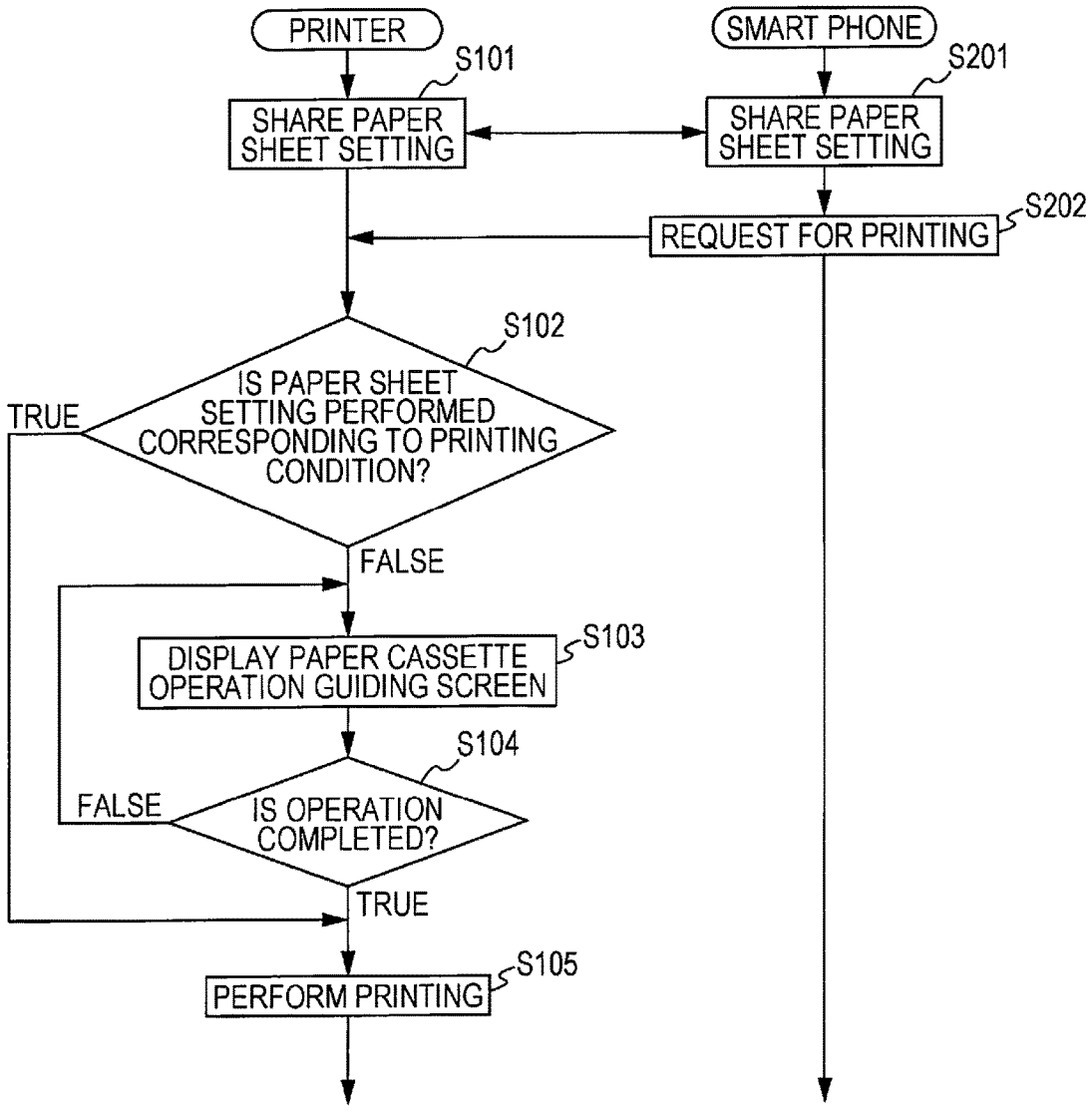
FIG. 8 is a flowchart according to still another embodiment of the invention.

According to the present example, a print control method used when an external device causes the printer 1 to perform printing will be described with reference to FIG. 8. After a print control program starts in the portable information terminal 2 which is an external device, a print control process shown in FIG. 8 starts when the portable information terminal 2 is connected to the printer 1 such that a near field communication between the communication unit 15 and the portable information terminal 2 of the printer 1 is performed.

First, in response to a request of the portable information terminal 2, the control unit 11 of the printer 1 transmits the size and property of the paper sheet held in the operable tray to the portable information terminal 2, the size and property are received by the portable information terminal 2, and thereby, the portable information terminal 2 shares the paper-sheet setting of the printer 1 (S101 and S201). At this time, the control unit 11 of the printer 1 transmits the size and the property of the paper sheet held in the operable tray to the portable information terminal 2 based on the stored pressure cassette setting. Here, the communication unit 15 of the printer 1 may also transmit the sizes and properties of the paper sheet to the portable information terminal 2 through the near field communication, Wi-Fi direct communication between the portable information terminal 2 and the printer 1 may be established after account information called an SSID or a passphrase is shared there between through the near field communication, and the sizes and properties of the paper sheet held in the operable tray may be transmitted to the portable information terminal 2 through the Wi-Fi direct communication.

When the size and property of the paper sheet held in the operable tray of the printer 1 are acquired, the portable information terminal 2 causes a printing condition setting screen to be displayed in a state in which the size and property of the paper sheet held in the operable tray of the printer 1 are selected and printing conditions are set by the user. The user changes setting of the paper sheet or a print request is instructed through an operation on the printing condition setting screen. Subsequently, the portable information terminal 2 transmits a print request to the printer 1 in response to the operation of the user (S202). The print request contains the printing target and the size and property of the printing paper sheet.

When the print request is received, the control unit 11 of the printer 1 determines whether or not the size and property of the paper sheet which are designated in the received print request are coincident with the size and property of the paper sheet held in the operable tray (S102).

In a case where the size and property of the paper sheet which are designated in the received print request are coincident with the size and property of the paper sheet held in the operable tray, the control unit 11 of the printer 1 controls the printing unit based on the print request such that the printing unit performs printing (S105).

Figure 9A:
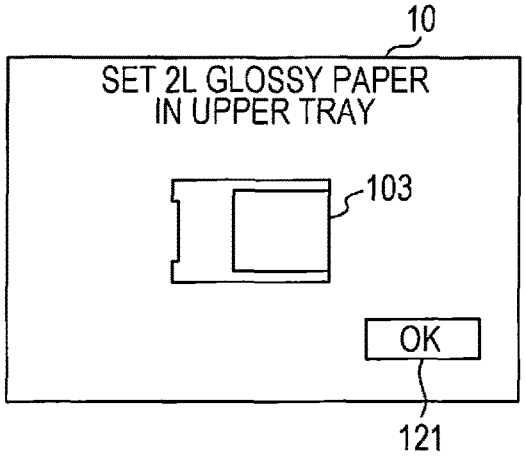
FIGS. 9A to 9C are diagrams of screen transition according to the embodiment of the invention.
Figure 9B:
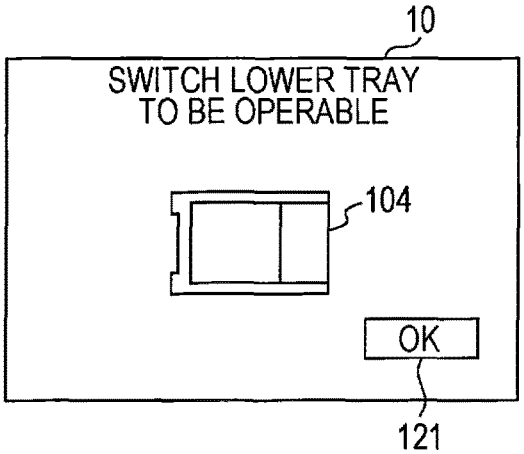
Figure 9C:
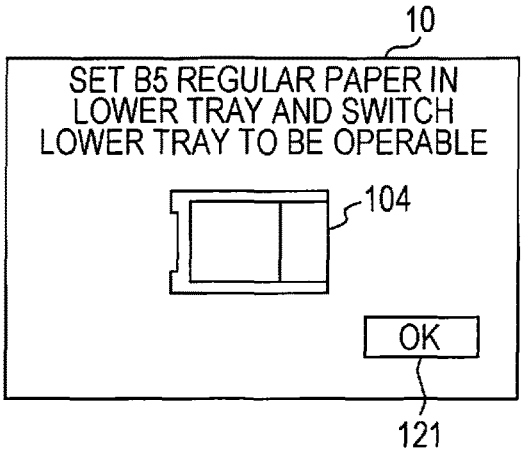

In a case where the size and property of the paper sheet which are designated in the received print request are not coincident with the size and property of the paper sheet held in the operable tray, the control unit 11 of the printer 1 causes a paper cassette operation guiding screen to be displayed on the touch panel 10 (S103). Specifically, as shown in FIG. 9A, FIG. 9B, and FIG. 9C, a message that provides guidance of an operation method of the paper cassette and an icon 121 for instructing a print start, after an operation of setting the paper sheet designated in the print request in the paper cassette is completed, are disposed on the paper cassette operation guiding screen.

In a case where the paper sheet having the size designated in the print request can be held in the operable tray, guidance that urges the user to set the paper sheet designated in the print request in the operable tray is disposed on the paper cassette operation guiding screen. For example, as shown in FIG. 2, when a print request in which a size of "2L" is designated is received in a state in which the paper cassette setting is stored in the control unit 11, the control unit 11 causes the paper cassette operation guiding screen shown in FIG. 9A to be displayed on the touch panel 10. As shown in FIG. 2, the upper tray 52, in which the paper sheet having the size of "L" is held, is set as the operable tray in a state in which the paper cassette setting is stored in the control unit 11 and the upper tray 52 can hold the paper sheet having the size of "2L". Therefore, on the paper cassette operation guiding screen, setting of the paper sheet having the size of "2L" in the upper tray 52 may be urged. In addition, the graphic 103 is disposed on the paper cassette operation guiding screen, thereby, the upper tray 52 is recognized to be the operable tray by the user and it is possible to enable the user to recognize that a switching operation for the operable tray does not need to be performed.

In a case where the paper sheet designated in the print request is held in a tray which is not the operable tray, guidance that urges a switching operation of the operable tray is disposed on the paper cassette operation guiding screen. For example, as shown in FIG. 2, when receiving a print request in which "recycled paper" having the size of "A4" is designated in a state in which the paper cassette setting is stored in the control unit 11, the control unit 11 causes the paper cassette operation guiding screen shown in FIG. 9B to be displayed on the touch panel 10. As shown in FIG. 2, in a state in which the paper cassette setting is stored in the control unit 11, the upper tray 52 in which the paper sheet having the size of "L" is set as the operable tray and the lower tray 51 holds the "recycled paper" having the size of "A4" which is designated in the print request. Therefore, on the paper cassette operation guiding screen, switching of the operable tray to the lower tray 51 may be urged. In addition, the graphic 104 representing the external appearance of the paper cassette 50 in which the lower tray 51 is set as the operable tray is disposed on the paper cassette operation guiding screen such that the user can easily understand the operation method of the paper cassette 50.

In addition, in a case where the paper sheet designated in the print request is not held in any tray, it not possible for the paper sheet to be held in the operable tray, and the paper sheet can be held only in a tray which is not the operable tray, switching of the operable tray is performed and guidance that urges an operation of setting the paper sheet designated in the print request in the switched operable tray is disposed on the paper cassette operation guiding screen. For example, as shown in FIG. 2, when a print request in which "regular paper" having the size of "B5" is received in a state in which the paper cassette setting is stored in the control unit 11, the control unit 11 causes the paper cassette operation guiding screen shown in FIG. 9C to be disposed on the touch panel 10. As shown in FIG. 2, the upper tray 52, in which it is not possible to hold the paper sheet having the size of "B5", is set as the operable tray in a state in which the paper cassette setting is stored in the control unit 11 and the lower tray 51 holds the "recycled paper" having the size of "A4" different from the size designated in the print request. Therefore, on the paper cassette operation guiding screen, the operable tray may be switched to the lower tray 51 such that setting of "recycled paper" having the size of "B5" in the lower tray 51 may be urged. In addition, the graphic 104 representing the external appearance of the paper cassette 50 in which the lower tray 51 is set as the operable tray is disposed on the paper cassette operation guiding screen and thereby, the user can easily understand the operation method of the paper cassette 50.

When the paper cassette operation guiding screen is displayed on the touch panel 10, the control unit 11 goes on to determine whether the touch panel 10 detects a tap on the icon 121 for instructing the print start (S104).

When the touch panel 10 detects a tap on the icon 121 for instructing the print start, the control unit 11 controls the printing unit and causes printing to be performed based on the print request (S105).

5. EXAMPLE 4

Figure 10:
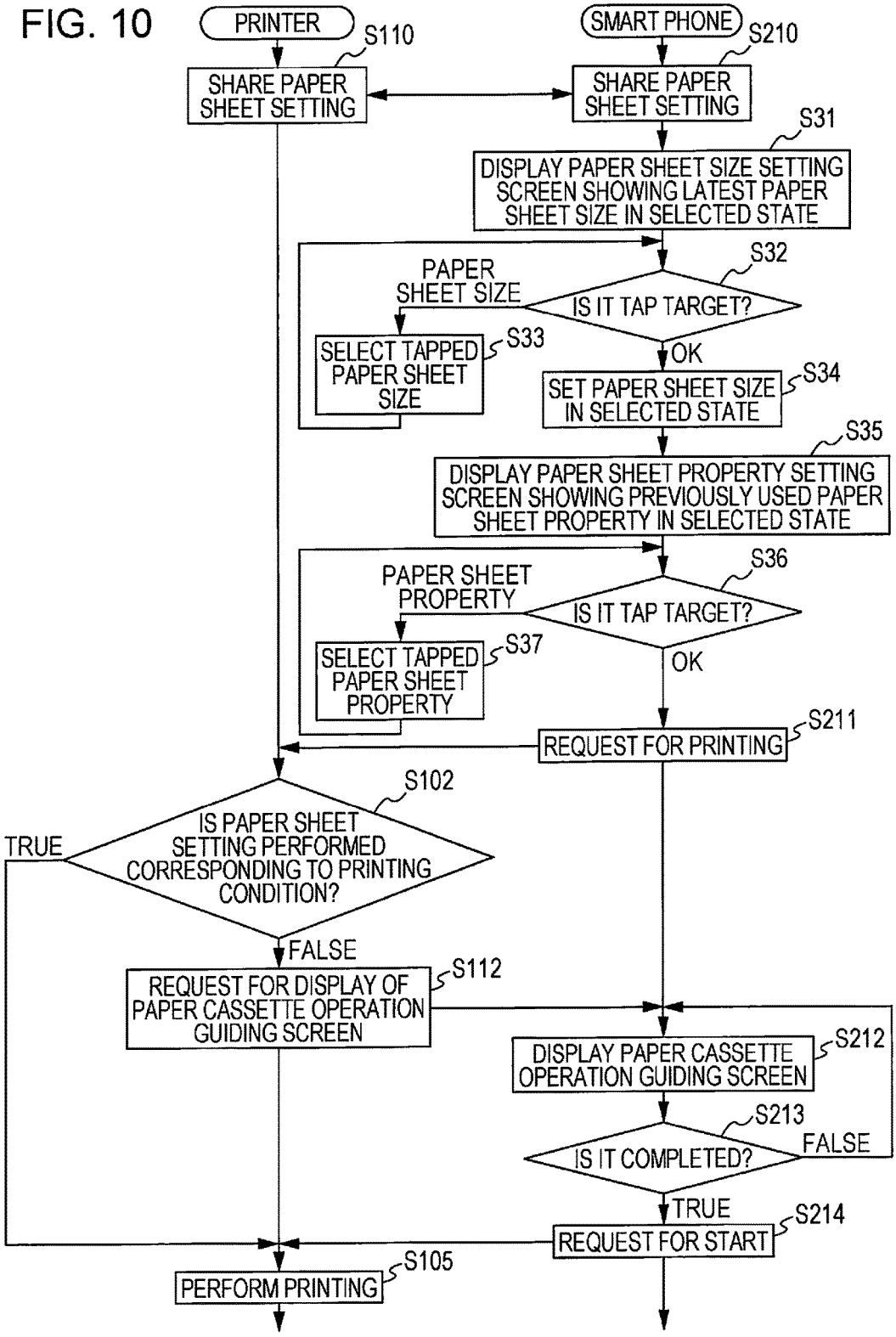
FIG. 10 is a flowchart according to still another embodiment of the invention.

According to the present example, when an external device causes the printer 1 to perform printing, a print control method in which the paper cassette operation guiding screen is displayed on the external device will be described with reference to FIG. 10. After a print control program starts in the portable information terminal 2 which is an external device, a print control process shown in FIG. 10 starts when the portable information terminal 2 is connected to the printer 1 such that a near field communication is performed.

First, in response to a request of the portable information terminal 2, the control unit 11 of the printer 1 transmits the paper cassette setting to the portable information terminal 2, the setting is received by the portable information terminal 2, and thereby, the portable information terminal 2 shares the paper cassette setting of the printer 1 (S110 and S210).

Figure 7B:
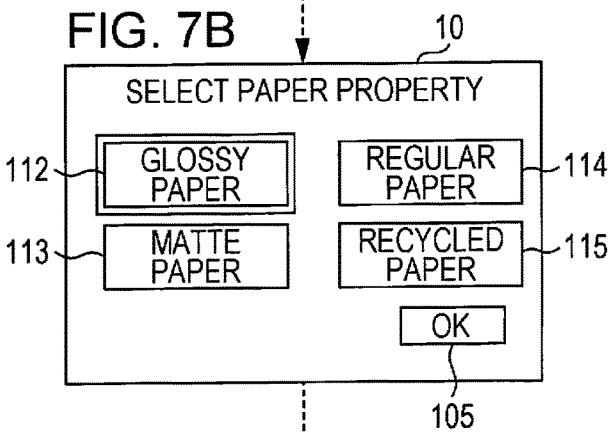
Figure 7C:
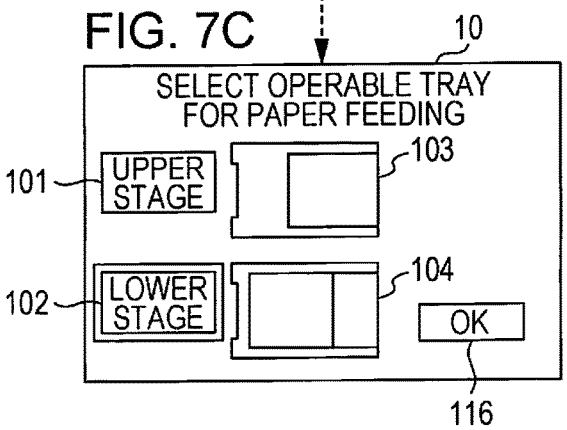
Figure 7D:
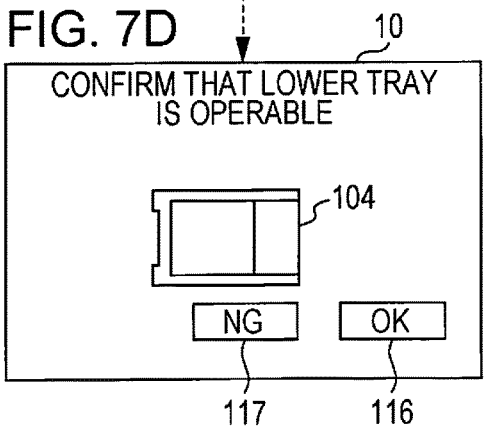

When the portable information terminal 2 shares the paper cassette setting of the printer 1, the portable information terminal 2 performs, from steps S31 to S36, the paper cassette setting process which has been described to be performed by the control unit 11 of the printer 1 according to Example 2. As a result, the user interface shown in FIG. 7A and FIG. 7B is displayed on the touch panel of the portable information terminal 2.

In step S36, when it is determined that the tap target is the "OK" icon 116 for setting the paper-sheet properties, which is in the selected state, the portable information terminal 2 transmits, to the printer 1, a print request in which the set size and property of the paper sheet are designated (S211).

When the print request is received, the control unit 11 of the printer 1 determines whether or not the size and property of the paper sheet which are designated in the received print request are coincident with the size and property of the paper sheet held in the operable tray (S102).

In a case where the size and property of the paper sheet which are designated in the received print request are coincident with the size and property of the paper sheet held in the operable tray, the control unit 11 of the printer 1 controls the printing unit based on the print request such that the printing unit performs printing (S105).

In a case where the size and property of the paper sheet which are designated in the received print request are not coincident with the size and property of the paper sheet held in the operable tray, the control unit 11 of the printer 1 transmits a display request of the paper cassette operation guiding screen to the portable information terminal 2 (S112).

When the display request is received, the portable information terminal 2 causes the paper cassette operation guiding screen to be displayed on the touch panel of the portable information terminal 2 (S212). Specifically, as shown in FIG. 9A, FIG. 9B, and FIG. 9C, the message that provides guidance of the operation method of the paper cassette, and the icon 121 for instructing a print start, after an operation of setting the paper sheet designated in the print request in the paper cassette is completed, are disposed on the paper cassette operation guiding screen.

At this time, the portable information terminal 2 causes a paper cassette operating screen to be configured based on the paper sheet which is designated in the print request, the operable tray which is stored as paper cassette setting, the paper sheet which is held in the operable tray, the paper sheet which is held in a tray that is not the operable tray, and paper sheets which can be held in the respective trays. In a case where the paper sheet that is designated in the print request is held in the operable tray, guidance of urging the user to set the paper sheet which is designated in the print request in the operable tray is disposed on the paper cassette operation guiding screen as shown in FIG. 9A. In addition, in a case where the paper sheet that is designated in the print request is held in a tray which is not the operable tray, guidance that urges the switching operation of the operable tray is disposed on the paper cassette operation guiding screen as shown in FIG. 9B. In addition, in a case where the paper sheet designated in the print request is not held in any tray, it not possible for the paper sheet to be held in the operable tray, and the paper sheet can be held only in a tray which, is not the operable tray, switching of the operable tray is performed and guidance that urges an operation of setting the paper sheet designated in the print request in the switched operable tray is disposed on the paper cassette operation guiding screen as shown in FIG. 9C. In addition, by executing a print driver which is controlled by communicating with the printing apparatus, the user may select a paper sheet through a personal computer. It can be applied not only to a case of a printing medium, but also to a case where a plurality of settings is performed by the user in place of setting the above-mentioned sizes or properties in an apparatus for performing a process in combination with a plurality of settings or a control apparatus thereof.

When the paper cassette operation guiding screen is displayed on a touch panel 21 of the printer 2, the portable information terminal 2 goes on to determine whether the touch panel detects a tag on the icon 121 for instructing the print start (S213).

When the touch panel detects a tap on the icon 121 for instructing the print start, the portable information terminal 2 transmits the print request to the printer 1 (S214) and causes the printer 1 to perform printing (S105). In a case where the paper sheet which is designated in the print request transmitted to the printer 1 from the portable information terminal 2 is coincident with the paper sheet held in the operable tray of the printer 1, step S112 is not executed in the printer 1. Thus, the portable information terminal 2 does not execute the process from step S212 to step S214.

According to the present example, since the setting of the printing paper sheet is performed by a user of the portable information terminal 2 in a state in which the portable information terminal 2 shares the paper cassette setting, it is possible for the printing paper sheet to be set by the user using a user interface which is in a state in which the paper sheet held in the operable tray is selected. That is, it is easy to set the paper sheet on which printing can be performed without an operation of the paper cassette 50 and to instruct the printing. In addition, even in a case where a paper sheet which is not held in the operable tray and printing is instructed, the paper cassette operation guiding screen is displayed on the portable information terminal 2. Thus, it is possible to prevent printing from being performed while the paper cassette 50 is set in a wrong state.

6. EXAMPLE 5

The portable information terminal 2 stores the size and property of the paper sheet whenever the print request may be transmitted to the printer 1 from the portable information terminal 2, a print property setting screen may be displayed, on which the property of the previously selected paper sheet is selected in combination with the selected size in response to selecting of the paper-sheet size on a print size setting screen, the print request in which the selected size and type of the paper sheet may be transmitted to the printer 1.

For example, as shown in FIG. 11, the portable information terminal 2 stores history of combination of the sizes and types of the paper sheets in ten print requests. In this manner, in a case where the portable information terminal 2 stores the sizes and types of the paper sheet, the portable information terminal 2 displays the paper-sheet size setting screen showing a state of selecting the "regular paper" having the latest size of "A4" set by the portable information terminal 2, irrespective of a state of the paper cassette 50 of the printer 1. When the user operates the paper-sheet size setting screen and selects the size of "2L", the portable information terminal 2 may display the paper-sheet property setting screen showing a state of selecting the latest "glossy paper" in combination with the size of "2L".

7. ANOTHER EMBODIMENT

The technical scope of the invention is not limited to the embodiments described above and it is needless to say that various modifications can be performed within the scope without departing the gist of the invention or combination of the examples can be modified.

For example, the paper-sheet properties as the paper-sheet types may be set before the paper-sheet sizes are set in the paper cassette setting process and the previously set paper-sheet size in combination with the set paper-sheet property may be first provided.

In addition, in a case where a user who is performing an operation can be identified, history may be stored for each user.

In addition, at the time of shipment before a user performs printing, a corresponding default paper-sheet property and paper-sheet size which is assumed by a manufacturer may be stored in history.

In addition, in the user interface for setting the type of the paper sheet, choices of the paper-sheet sizes or paper-sheet properties may be disposed in a drop-down list, a scrolling list, or a list called a list box. In this case, the previously set paper-sheet size or paper-sheet property may be first provided as a default selection value. Meanwhile, a method in which only a single choice is displayed is also included as one example of the methods in which a plurality of choices are provided.

In addition, in a printing apparatus which does not include both the paper cassette and the plurality of trays but includes only a single paper feeding path, choices of the specific types of printing media may be first provided using setting history of the printing media used two or more times. In this case, a sensor that detects that a printing medium is set in the printing unit may be provided and the user interface for setting the types of printing media may be displayed on a screen in a case where printing media are set in the printing unit.

In addition, the invention can be applied to a configuration in which three or more stages of trays are provided and one tray is set as the operable tray. In addition, the invention can be applied to a printing apparatus that includes a plurality of paper cassettes, each of which includes a plurality of trays. In this case, the operable tray may be set for each paper cassette by a user. Here, setting history of the types of paper sheets may be stored for each paper cassette and for each tray.

In addition, instead of the touch panel, the user interface may be configured to be operated using a display not having a function of detecting contact with a finger and a switch. In addition, the plurality of choices are displayed on a screen at once and selection is performed by a user; however, only a single choice may be displayed on a screen and the choices are switched in order and are displayed in response to an operation of the user. In this case, the choice displayed on the first screen is selected based on history. In addition, it is needless to say that the invention can also be applied to other printing apparatuses such as a page printer, in addition to the ink jet printer. In addition, by executing a print driver which is controlled by communicating with the printing apparatus, the user may select a paper sheet through a personal computer. It can be applied not only to a case of a printing medium, but also to a case where a plurality of settings is performed by the user in place of setting the above-mentioned sizes or properties in an apparatus for performing a process in combination with a plurality of settings or a control apparatus thereof.

What is claimed is:

1. A print control apparatus that controls a printing apparatus which performs printing on a printing medium, the print control apparatus comprising:

a display control unit that provides a plurality of choices for printing medium type setting and causes a user interface, on which a first one of the choices is selected by a user, to be displayed on a screen; and a storage unit that stores history of at least two sets of the printing medium type setting that have been performed by the user, wherein the display control unit further provides a second one of the choices on the user interface based on the history according to the first one of the choices in response to the first one of the choices being selected by the user, and the storage unit stores, as the history, a first set of the printing medium type setting that is performed most recently, and a second set of the printing medium type setting that is performed before the first set of the printing medium type setting is performed.

2. The print control apparatus according to claim 1, wherein the display control unit causes the user interface to be displayed on the screen when a printing medium is set in the printing apparatus.

3. The print control apparatus according to claim 2, wherein the choices include a plurality of options for a printing medium size setting and a plurality of options for a printing medium property setting, wherein the display control unit provides, on the user interface, the options for the printing medium size setting and the options for the printing medium property setting in a separate manner, and wherein, in response to a first one of the options for the printing medium size setting being selected, the display control unit provides a second one of the options for the printing medium property setting on the user interface based on the history, with the second one of the options for the printing medium property setting being stored in the history in association with the first one of the options for the printing medium size setting.

4. The print control apparatus according to claim 2, wherein the printing apparatus includes a plurality of paper feeding paths, wherein the display control unit provides, on the user interface, any one of the choices for each of the paper feeding paths, and causes any one of the choices to be selected by a user, and wherein the storage unit stores the selected choice for each of the paper feeding paths.

5. The print control apparatus according to claim 2, wherein the printing apparatus includes a plurality of paper feeding paths through which different printing media are supplied, and wherein the display control unit provides, on the user interface, any one of the plurality of paper feeding paths according to the choice selected by a user, as a paper feeding path corresponding to the choice selected by the user.

6. The print control apparatus according to claim 3, wherein, when one of the options for the printing medium size setting is selected on the user interface, out of a plurality of options for the printing medium property setting that are formerly selected in combination with the selected one of the options for the printing medium size setting, the display control unit provides, on the user interface, the latest one of the options for the printing medium property setting that is selected most recently in combination with the selected one of the options for the printing medium size setting.

7. The print control apparatus according to claim 1, wherein the display control unit causes the user interface for setting of printing condition by a user to be displayed on the screen.

8. The print control apparatus according to claim 7, wherein the choices include a plurality of options for a printing medium size setting and a plurality of options for a printing medium property setting, wherein the display control unit provides, on the user interface, the options for the printing medium size setting and the options for the printing medium property setting in a separate manner, and wherein, in response to a first one of the options for the printing medium size setting being selected, the display control unit provides, on the user interface, a second one of the options for the printing medium property setting that is formerly selected in combination with the first one of the options for the printing medium size setting.

9. The print control apparatus according to claim 7, further comprising:

a communication unit that communicates with an external device through near field communication, wherein the display control unit controls the user interface in the external device through the communication unit.

10. A print control program which is executed by a computer controlling a printing apparatus that performs printing on a printing medium and which is stored in a nonvolatile storage medium, the print control program comprising functions of:

providing a plurality of choices for printing medium type setting and causing a user interface, on which first one of the choices is selected by a user, to be displayed on a screen;

storing history of at least two sets of the printing medium type setting that have been performed by the user; and providing second one of the choices on the user interface based on the history according to the first one of the choices in response to the first one of the choices being selected by the user, the storing of the history including storing, as the history, a first set of the Printing medium type setting that is performed most recently, and a second set of the printing medium type setting that is performed before the first set of the printing medium type setting is performed.

11. The print control apparatus according to claim 2, wherein the choices include a plurality of options for a printing medium size setting and a plurality of options for a printing medium property setting, wherein the display control unit provides, on the user interface, the options for the printing medium size setting and the options for the printing medium property setting in a separate manner, and wherein, in response to a first one of the options for the printing medium property setting being selected, the display control unit provides a second one of the options for the printing medium size setting on the user interface based on the history, with the second one of the options for the printing medium size setting being stored in the history in association with the first one of the options for the printing medium property setting.

12. The print control apparatus according to claim 11, wherein, when one of the options for the printing medium size setting is selected on the user interface, out of a plurality of options for the printing medium property setting that are formerly selected in combination with the selected one of the options for the printing medium size setting, the display control unit provides, on the user interface, the latest one of the options for the printing medium property setting that is selected most recently in combination with the selected one of the options for the printing medium size setting.

13. The print control apparatus according to claim 3, wherein, when one of the options for the printing medium property setting is selected on the user interface, out of a plurality of options for the printing medium size setting that are formerly selected in combination with the selected one of the options for the printing medium property setting, the display control unit provides, on the user interface, the latest one of the options for the printing medium size setting that is selected most recently in combination with the selected one of the options for the printing medium property setting.

14. The print control apparatus according to claim 11, wherein, when one of the options for the printing medium property setting is selected on the user interface, out of a plurality of options for the printing medium size setting that are formerly selected in combination with the selected one of the options for the printing medium property setting, the display control unit provides, on the user interface, the latest one of the options for the printing medium size setting that is selected most recently in combination with the selected one of the options for the printing medium property setting.

15. The print control apparatus according to claim 7, wherein the choices include a plurality of options for a printing medium size setting and a plurality of options for a printing medium property setting, wherein the display control unit provides, on the user interface, the options for the printing medium size setting and the options for the printing medium property setting in a separate manner, and wherein, in response to a first one of the options for the printing medium property setting being selected, the display control unit provides, on the user interface, a second one of the options for the printing medium size setting that is formerly selected in combination with the first one of the options for the printing medium property setting.

* * * * *